US008702405B2

(12) United States Patent
Verrilli

(10) Patent No.: US 8,702,405 B2
(45) Date of Patent: Apr. 22, 2014

(54) TWISTING TRANSLATIONAL DISPLACEMENT PUMP CARTRIDGE

(76) Inventor: Brian Leonard Verrilli, Carlsbad, CA (US)

( * ) Notice: Subject to any disclaimer, the term of this patent is extended or adjusted under 35 U.S.C. 154(b) by 545 days.

(21) Appl. No.: 12/927,660

(22) Filed: Nov. 19, 2010

(65) Prior Publication Data

US 2011/0073620 A1 Mar. 31, 2011

Related U.S. Application Data

(63) Continuation-in-part of application No. 11/985,652, filed on Nov. 17, 2007, now abandoned.

(51) Int. Cl.

| | |
|---|---|
| ***F04B 19/22*** | (2006.01) |
| ***F04B 7/04*** | (2006.01) |
| ***F01B 7/02*** | (2006.01) |
| ***F04B 19/02*** | (2006.01) |

(52) U.S. Cl.

CPC ..... *F04B 7/045* (2013.01); *F04B 19/025* (2013.01)

USPC ..... 417/461; 417/488; 417/498; 92/75

(58) Field of Classification Search

CPC ..... F04B 7/045; F04B 19/025

USPC ..... 417/461, 468, 486, 487, 488, 490, 498, 417/415; 92/75

See application file for complete search history.

(56) References Cited

U.S. PATENT DOCUMENTS

| | | | | |
|---|---|---|---|---|
| 1,689,419 | A | 10/1928 | Bronander | |
| 1,748,810 | A | 2/1930 | Wandel | |
| 2,605,042 | A | 7/1952 | Reutter | |
| 2,867,375 | A | 1/1959 | Peterson | |
| 3,747,479 | A | 7/1973 | Nightengale et al. | |
| 4,872,313 | A | 10/1989 | Kazumoto et al. | |
| 5,639,220 | A * | 6/1997 | Hayakawa | 417/53 |
| 5,720,415 | A * | 2/1998 | Morningstar | 222/1 |
| 5,967,757 | A | 10/1999 | Gunn et al. | |
| 6,004,117 | A * | 12/1999 | Brunk | 417/488 |
| 6,499,972 | B2 | 12/2002 | Yatsuzuka et al. | |
| 6,719,542 | B2 * | 4/2004 | Shibuya | 417/490 |
| 6,935,539 | B2 | 8/2005 | Krieger et al. | |
| 7,156,626 | B2 | 1/2007 | Park et al. | |
| 7,207,780 | B2 | 4/2007 | Bach | |
| 2005/0135952 | A1 * | 6/2005 | Bach | 417/487 |
| 2006/0257274 | A1 * | 11/2006 | Umeoka et al. | 417/415 |

* cited by examiner

*Primary Examiner* — Bryan Lettman

(57) ABSTRACT

A pump cartridge which has a polymer shell with moveable cores inserted from each end. The polymer shell contains perpendicular passages along the top for connection of fluid supply and prime chambers. Statically mounted elastomers adjacent to perpendicular passages provide sealing around movable cores. Fluid moves by translation within the pump cartridge by filling the cavity volume between the oblate ends of the moveable cores with a liquid and matching the rotation angle and translation position of advancing left moveable core with retreating right moveable core, maintaining equivalent volume. Both moveable cores can be directed toward one another or one moveable core can remain stationary while the other advances to extrude fluid. Pump cartridge rotation changes the angle of the fluid exit passage.

10 Claims, 7 Drawing Sheets

TWISTING TRANSLATIONAL DISPLACEMENT PUMP CARTRIDGE

CROSS REFERENCE TO RELATED APPLICATIONS

This is a continuation of application Ser. No. 11/985,652, filed 17 Nov. 2007.

FEDERALLY FUNDED RESEARCH

Not Applicable

SEQUENCE LISTING OR PROGRAM

Not Applicable

BACKGROUND OF INVENTION

1. Field of the Invention

This invention pertains to the field of liquid dispensing equipment. More particularly, it pertains to design of a pump that employs a novel method of pumping or extruding a fluid. The pump design is capable of accomplishing this task without the use of valves or redirection of fluid through ancillary pathways. Both cores occupy a polymer shell; each core is inserted from opposite ends, a reservoir and a prime chamber are installed on the topside of the polymer shell. The exit perpendicular passage is directly below and provides for connection of a nozzle or other passage for extrusion of the fluid.

2. Description of the Prior Art

At present there are four general types of pumps used to underfill electronic devices with viscous liquid: (1) A screw or auger type pump comprised of a rotating helix or thread turning inside a cylindrical chamber, the liquid is pumped as a result of shear of the fluid, forward pressure builds as a function of the cosine of the helix angle. (2) An air over type pump, constructed using a cylindrical cavity or syringe, utilizes a column of fluid or reservoir with a follower or concave disc placed on top, air pressure creates the force to move the liquid by acting on the surface area of the follower, toggling the air on and off starts and stops the flow. (3) A jet type pump constructed from a poppet valve, the poppet valve is a rod with a spherical end that moves in a translational fashion over a puddle of fluid, a carbide orifice below the puddle provides the path for a minute quantity of liquid to be expelled as the spherical end impacts the puddle. (4) A positive displacement type pump moves a column of liquid by displacement of a volume of fluid in the chamber equal to the quantity extruded through the exit port, the rate of flow through the exit port is a function of the speed the piston advances multiplied by the volume displaced.

Pumps made for dispensing of viscous fluids by positive displacement require a provision in the design to accomplish the three distinct tasks to ready the pump for its intended function. The three machine states are prime, refill and dispense.

The first state, prime, is performed apriori of dispensing the fluid. It is always required of this type of pump to fill the pump cavity with fluid that is free of air bubbles. Precision dispensing of fluid using the positive displacement technique is susceptible to error in the dispensed volume from air entrapped in the fluid. The problem has a negative impact on the pump repeatability due to the inherent compressibility of air in contrast to the relative incompressibility of most liquids. Two techniques commonly used to rid the pump of this nuisance variable are: Pushing the fluid through the cavity until all air is displaced and the entire volume is homogeneous with respect to fluid, the second is pulling the liquid through the cavity by use of vacuum to achieve the same. Both techniques require this task to be accomplished until all air is dispelled; usually this requires visual inspection of the fluid exiting the chamber via a clear tube. All pumps available for use in the semiconductor industry today discard primed fluid as waste; this practice is expensive due to the high cost of the fluid. Sensors or cameras can be used to detect the presence of oxygen or bubbles; it is possible to automate the process.

The second state, refill, is accomplished immediately after priming the pump and after the fluid in the chamber is depleted at the conclusion of a dispense. Refill of the chamber occurs when the piston in the pump is retracted at the same rate as liquid from the fluid reservoir advances. Fluid from the reservoir is pushed forward by gravity, air pressure or mechanical means, simultaneously filling the cavity, preventing entrapment of air in the liquid. Cavitation occurs when a liquid contains air or other compressible gas as a result of not advancing to fill the volume as rapidly as the piston retracts. If this happens, the pump must be primed again or accuracy and repeatability of the volume dispensed will be poor. Solutions used in semiconductor applications are expensive and pumps with no capacity to reuse the fluid expelled from the prime state are costly to operate.

The third state, dispense, occurs after the pump has been primed, refilled and the piston is at the top of the cylinder poised to push the column of fluid through the exit port. The exit port provides a mechanical connection for a nozzle or attachment of another passage for extrusion of the fluid.

The current trend in the industry is to construct and design pumps of the positive displacement type using one piston for each fluid cavity. Pumps are generally mounted in the upright configuration; the chamber attitude is perpendicular to the surface of the earth. Some manufacturers employ the concept of dual chambers side by side with one piston per cavity. This method is used to mask refill time, one chamber can dispense while the other refills.

OBJECTS AND ADVANTAGES

Accordingly, the design and the method of operation of a twisting translational displacement pump cartridge have inherent objects and advantages that were not described earlier in my patent. Several additional objects and advantages of the present invention are:

(1.) To provide a method of moving a liquid using the positive displacement principle wherein no valves or ancillary passages are necessary to change the state of the pump cartridge from the prime position, to the refill position, to the dispense position. The three different machine states occur in a single polymer shell with multiple cavities.

(2.) To provide a design for a pump cartridge which is capable of using liquid that is dispelled during the prime operation and reuse it to refill the pump cartridge cavity for a dispense cycle. This obsoletes any requirement for operator contact with the solution.

(3.) To provide a design for a pump cartridge that is capable of rotating the exit perpendicular passage around the moveable cores to facilitate placing a fluid deposit at angles other than perpendicular with respect to a work plane.

(4.) To provide a design for a pump cartridge that can be held close to the mounting platform of a robot and limit force acting on robot mechanics, to prevent a pendulum effect under high acceleration and deceleration. The cavity attitude is parallel to the work plane.

(5.) To provide a design for a pump cartridge that has the capability to shut off the exit perpendicular passage from fluid flow without interfering with the dispense cycle.

(6.) To provide a design for a pump cartridge that has the capacity to increase flow-rate by an order of magnitude from the inherent design detail of dual moveable cores occupying the same cavity. Both moveable cores separated by a column of fluid can push from either end of the fluid column positioned over the exit perpendicular passage of the cavity.

(7.) To provide a pump cartridge design with a high degree of rigidity in comparison to existing industry designs through the absence of valves that contain seals or packing that must comply under pressure to stop leakage. The act of compliance changes cavity volume and increases error in the fluid deposit.

(8.) To provide a pump cartridge design with the ability to accept a variety of different size moveable cores and polymer shell sets. This tailors the dispensed quantity of liquid to the application, since positional error present in piston location can act over a smaller or larger cross sectional area, impacting the percentage of the error present in the volume of material deposited from variance in piston placement.

(9.) To provide a pump cartridge design with a fluid path that is as short as possible. The length of the exit port is equal to the thickness of the wall. The bulkhead thickness is sized to resist the internal pressure that results from force exerted by moveable core advancement on the column of liquid without deflection as a result of hoop stress acting on the bulkhead from pressure inside the cavity, plus the length of the detail required for connection of the nozzle.

(10.) To provide a pump cartridge design capable of refilling from a bulk fluid supply.

(11.) To provide a pump cartridge design that is able to transport a fluid between two perpendicular passages by moveable cores twisting translating movement in opposite directions at the same twist rate. The right moveable core would move forward, the left moveable core would move backward, the column of liquid would occupy the volume between the two.

(12.) To provide a pump cartridge design that can switch reservoirs without stopping to change a reservoir that is depleted of fluid.

13.) To provide a pump cartridge design that has the ability to suck fluid back to alleviate excess fluid extrusion.

14.) To provide a pump cartridge design that can create vacuum by pulling back the moveable cores, eliminating the use of air pressure to push fluid from the prime chamber, reservoir or bulk supply.

15.) To provide a pump cartridge design that has the capacity to support formulation of a compressibility offset for fluids like sealants and silicones that have a high degree of elasticity and move sluggishly until compressed slightly.

16.) To provide a pump cartridge design that enables cores to twist as they translate to ease insertion force required for intermittent contact.

17.) To provide a pump cartridge design that maintains a thin fluid film around bulkhead walls to aid viscous fluid wetting and reduce propensity for internment of air bubbles at the bulkhead fluid interface.

SUMMARY OF THE INVENTION

The invention is a novel method of designing a pump for delivering a measured quantity of viscous liquid or other liquids through a nozzle for deposit or connection to another passage for extrusion of the fluid. Fluid forced through the exit passage of the pump enters a nozzle that directs it for deposit. A twisting translational displacement pump cartridge comprises:

A polymer shell with a large cavity between two or more smaller cavities with a series of perpendicular passages through the bulkhead perpendicular to the longitudinal axis enables connection of a prime chamber, reservoir, a bulk supply of fluid and a nozzle. Two moveable cores are inserted from each end of the polymer shell; they are slightly smaller than the inside diameter of the smaller cavities. The smaller cavities each contain statically mounted elastomers installed in interior sulcusci adjacent and within close proximity to the bulk feed or prime perpendicular passage, reservoir perpendicular passage and exit perpendicular passage. Perpendicular passages are attached to standard tapers for connection to a nozzle, fluid source, and prime chamber. Installing component parts and joining each side in a fluid tight manner reduces cost and difficulty involved in the manufacture of the polymer shell. A pressure sensor is provided for determining pressure. The gear and bearing surfaces allow rotation of the polymer shell.

Moveable cores used are hollow to enable them to twist and ease insertion force requirements from intermittent contact with the elastomers. The oblate ends have a radius or a chamfer to help ease transition as the elastomers are compressed against the polymer shell.

In contrast to conventional positive displacement pumps used in the industry that use a valve or stopcock to switch between prime, refill and dispense, a twisting translational displacement pump cartridge has no such device in the circuit to divert the flow of fluid; however, to accomplish the required machine states of prime, refill and dispense it is necessary to introduce a fourth state, translate. This state is necessary to divert flow before dispense of fluid through the exit passage.

When the pump cartridge is in operation, moveable cores within the cavities contained in the polymer shell move in concert with one another to expose or cover ports that form the passages for connection of the prime chamber, reservoir or a bulk supply of fluid for automated refill of the reservoir and a nozzle. The device moves both the moveable cores at identical pitch and speed in opposite directions to move the volume of liquid contained between them to the appropriate passage to accomplish the intended function. To clarify the position of the left and right moveable cores with respect to the passages, the rearward edge of the passage is the side that uncovers the passage; the forward edge is the side that covers the passage.

The first machine state, Prime, is achieved by twisting translational movement of the right moveable core to a position within the polymer shell tangent to the rearward edge of the prime passage, exposing the passage. The left moveable core is moved by twisting translational movement to a position tangent to the rearward edge of the reservoir passage, exposing the passage. This exposes a path for fluid to flow between the two openings. The force required to move the liquid can be produced by a number of methods, air pressure acting on the area of the column of fluid contained in the reservoir can be applied to push the fluid, vacuum can be applied to the prime chamber to pull the liquid from the reservoir through the large cavity within the polymer shell into the prime chamber or movement of the two moveable cores can be used to create a vacuum. This can be accomplished by twisting movement of both moveable cores to a position under the reservoir passage, with ends touching each other that bisect the opening across its diameter. The left moveable core retracts, twisting counterclockwise to a position tangent to the rearward edge of the reservoir passage and stops at that position, the right moveable core moves backward and parks tangent to the rearward edge of the prime chamber passage. The left moveable core twisting as it translates moves from the stationary position forward, closing the reservoir passage, pushing the fluid column into the prime chamber and comes to rest against the right moveable core. The right moveable core twists forward or clockwise and the left moveable core twists backward or counterclockwise with ends touching each other, bisecting the reservoir opening across its diameter to repeat the process, if required to expel air entrapped in the fluid.

The second machine state, Refill, is achieved by positioning the left moveable core at the forward edge of the reservoir passage; the right moveable core resides in the same location with the ends of the cores in contact with each other.

The right moveable core remains stationary while the left moveable core twists while translating backward or counterclockwise creating a negative pressure, allowing fluid from the reservoir to advance to fill the increasing volume formed by the retreat of the left moveable core. Retreat of the left moveable core is halted once a position tangent to the forward edge of the exit passage is reached.

The third machine state, Translate, occurs after Refill or when movement of fluid is desired without displacement or extrusion. The Translate state is a function of the specific application of the pump. The right moveable core advances at the same pitch or rate of twist as the left moveable core retreats, the volume of fluid flanked by the two moveable cores is moved; therefore, in this machine state the pitch or number of turns of the moveable core for a given displacement in the polymer shell determines the velocity. The velocity of advance of the right moveable core is equal to the retreat of the left moveable core.

The fourth machine state, Dispense, requires the left moveable core be positioned at the rearward edge of the exit passage. The right moveable core is separated from the left moveable core by the volume of fluid. Twisting translating advance of the right moveable core toward the left moveable core causes pressure inside the cavities contained within the polymer shell to build and the fluid is displaced through the exit passage and out the nozzle for deposit on the work plane. Alternately, the column of liquid can also be positioned in the center of the exit passage and left and right moveable cores can advance toward each other in a clockwise rotation extruding the fluid out the exit passage at a rate of flow equal to twice the rate possible from the advance of one moveable core.

Ordinarily, width of the fluid deposit is a function of the nozzle diameter selected, the flow rate through the pump cartridge and the velocity the pump is moved over the work; however, the twisting translational displacement pump cartridge can rotate the exit passage to which the nozzle is attached to angles other than 90° with respect to the work piece. This attribute enables further control of line width by virtue of the following relation: $\sqrt{Ø_{Inside\ Nozzle}^2 - Z^2} = X_{Approximate\ Line\ Width\ Effect}$ The $X_{Approximate\ Line\ Width\ Effect}$ requires application of fluid along the positive or negative Y axis, convention for axis orientation is established according to the "right-hand rule". No $X_{Approximate\ Line\ Width\ Effect}$ is observed as a result of the nozzle angle if the fluid dispensed by the pump cartridge is oriented in a direction parallel to the angle, the pump cartridge must dispense fluid perpendicular to the angle of the nozzle for the angle to have an effect on the width of the line. Rotation of the exit passage is also useful to move the nozzle out of the way to clear components to move the pump cartridge to a different dispense location and aid in fluid break off without a change in Z-axis height.

Additionally, the design of the twisting translational displacement pump cartridge lends itself to replenishment of the onboard fluid reservoir by mating to a bulk supply of fluid. The addition of a bulk supply passage allows the pump to position the moveable cores tangent to the bulk feed supply passage. The right moveable core remains tangent to the rearward edge of the bulk feed supply passage, exposing the passage and the left moveable core retreats twisting counterclockwise to the rearward edge of the onboard fluid reservoir passage exposing the passage. Providing the path for fluid to flow from the bulk fluid supply to refill the onboard fluid reservoir. The prime operation in this configuration is accomplished using the bulk fluid supply passage for connection to a prime chamber to act as the repository for expulsion of fluid in the prime state.

These and other objects of the invention will become clearer when one reads the following specification, taken together with the drawings that are attached hereto. The scope of protection sought by the inventor may be gleaned from a fair reading of the Claims that conclude this specification.

DESCRIPTION OF THE DRAWINGS

Figures

Turning now to the drawings wherein elements are identified by numbers and like elements are identified by like numbers throughout the nine figures, prior art is depicted in FIG. 1.

DESCRIPTION OF THE PREFERRED EMBODIMENT

Figure 1:
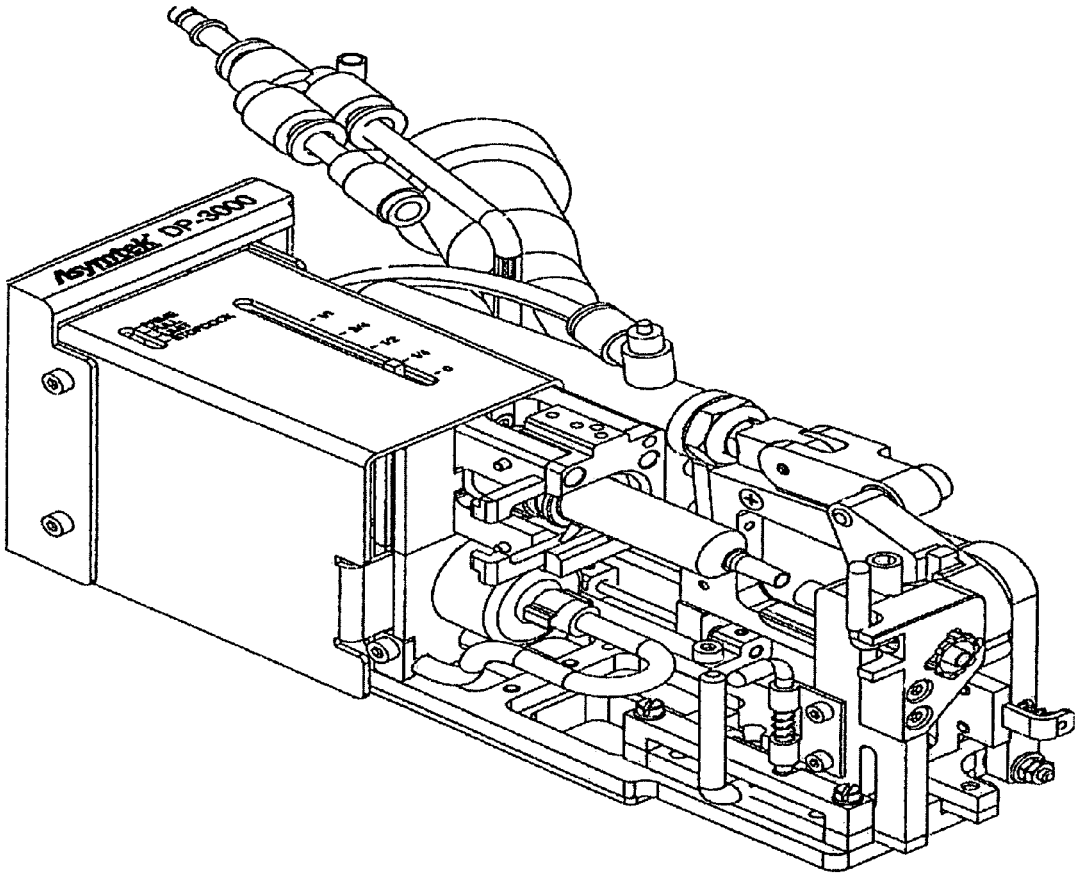
(Prior Art) Fig. 1

Referring now to the drawings wherein the showings are for the purpose of illustrating preferred embodiments of the invention only and not for the purpose of limiting it. FIG. 1 Prior Art positive displacement pump is an automated device that moves fluid by filling a cavity with fluid and extruding the fluid through displacement of volume by a cylinder that is pushed into the fluid filled cavity. A seal around the cylinder prevents fluid leakage upward so as to direct fluid downward out the end of the cavity. Fluid is directed through a disposable polycarbonate medical stopcock to a nozzle for deposit onto the work. The stopcock is an essential component of the device. It is used to switch between refill of the chamber and extrusion of fluid out of the cavity. The pump is primed by retracting the cylinder to a position above the seal to enable fluid to flow from an on board reservoir through the stopcock up the chamber and out the pump for the purpose of ejecting air bubbles and air pockets that can be present when fluid first fills the pump cavity. The pump uses a rotary encoder to determine speed and relative position; photoelectric switches and flags are used to determine absolute position limits. A pneumatic actuator toggles the stopcock between refilling of the pump cavity and dispensing fluid. A Hall effect sensor and two magnets indicate stopcock position. The pump is sensitive to over pressurization of the stopcock at high rates of flow. Constrictive nozzle designs, a long fluid path combined with high viscosity liquids cause high pressures, when this occurs the pump leaks fluid from around the rotary seal of the stopcock. Lack of a linear encoder means all measures of cylinder position are estimated and are not an absolute measure of position.

Figure 2:
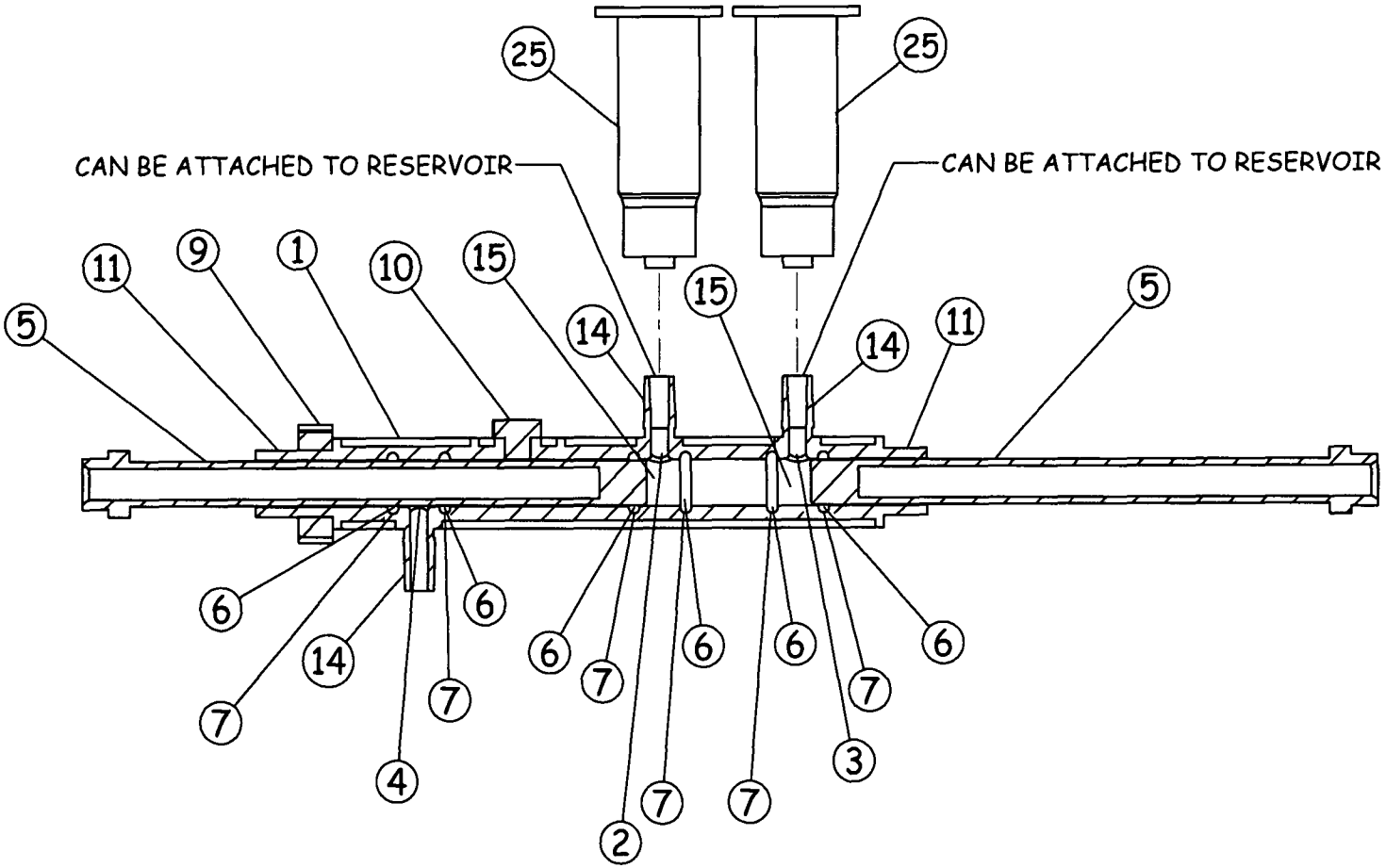
FIG. 2 is an illustrative view of first machine state of operation, "Prime", this state is also identical to the process of re-supply of an on board fluid reservoir from a bulk supply of liquid.
Figure 6:
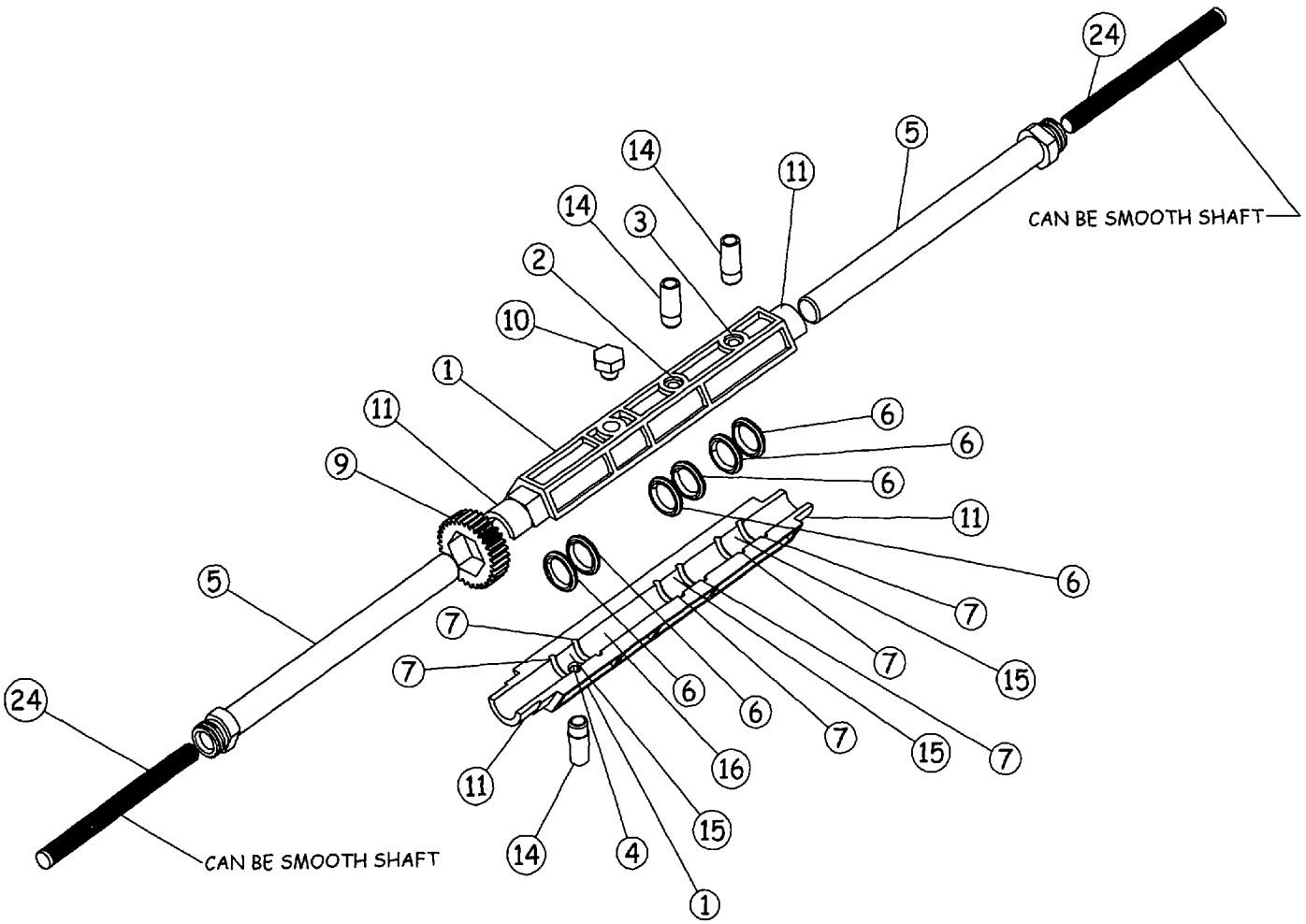
FIG. 6 is an illustrative view of the basic Twisting Translational Displacement Pump Cartridge components.
Figure 7:
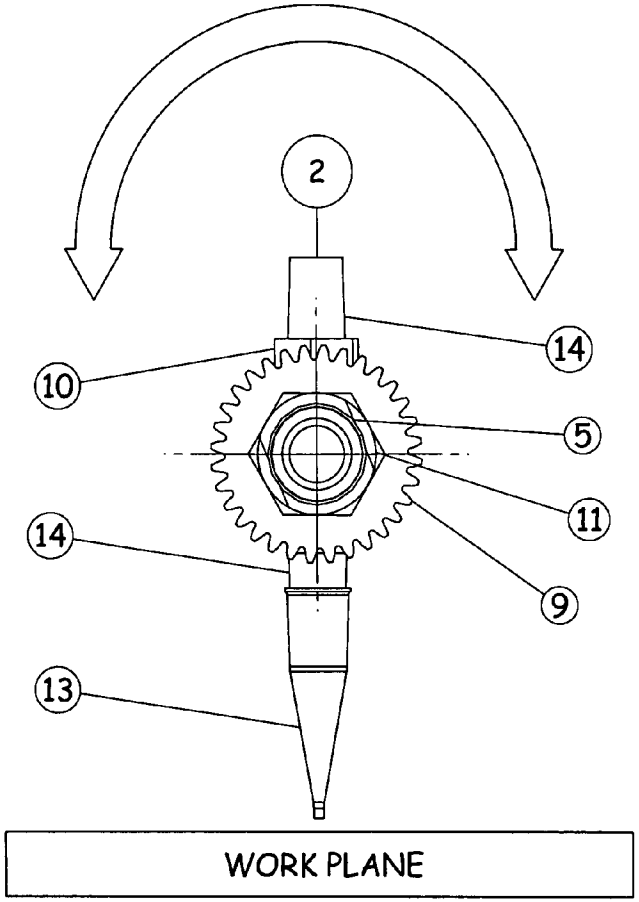
FIG. 7 is an end view of the Twisting Translational Displacement Pump Cartridge from the gear side depicting rotation of the perpendicular passage to angles other than perpendicular to the work plane.

The invention is a novel design for a Twisting Translational Displacement Pump Cartridge. The inventive Twisting Translational Displacement Pump Cartridge is depicted in FIG. 2, in a horizontal attitude, as it would be used in service in the industry. The sequence of steps or "machine states" and manner of movement between them is a key aspect to novel operation of the device. To accurately show the sequence of moves, FIGS. 2, 3, 4, 5 are displayed as cut away views of the device. FIG. 6 is an exploded view and FIG. 7 is an end view. It is preferred the pump be made from a polymer shell 1 with a series of perpendicular passages 2, 3, 4 through the bulkhead perpendicular to the longitudinal axis for installation of a standard taper 14 enabling connection of a prime chamber 25, a reservoir 25, a bulk supply of fluid 25 and a nozzle 13 to dispense the liquid onto the work plane. Two moveable cores 5 are inserted from each end of the polymer shell 1; they are smaller than the inside diameter of the smaller cavities 15 and the large cavity 16. Statically mounted elastomers 6 are installed in interior sulcusci 7 in each smaller cavity 15 adjacent and within close proximity to the bulk feed or prime perpendicular passage 3, reservoir perpendicular passage 2 and exit perpendicular passage 4. Moveable cores 5 compressing statically mounted elastomers 6 in interior sulcusci 7 hold back the high pressure created in the large cavity 16 from extrusion of fluid out the exit perpendicular passage 4 through the nozzle 13 and onto the work plane. Rotation to an angle other than 90 degrees to the work plane is accomplished by a gear 9 and bearing surfaces 11. A pressure sensor 10 is provided to determine pressure in the large cavity 16. The position of the two moveable cores 5 provide the means to shut off or block the flow of liquid from the reservoir perpendicular passage 2 and prime or bulk feed perpendicular passage 3.

To clarify the position of the left and right moveable cores 5 with respect to the perpendicular passages 2, 3, 4, the rearward edge of the perpendicular passage 2, 3, 4 is the side that uncovers the perpendicular passage 2, 3, 4; the forward edge is the side that covers the perpendicular passage 2, 3, 4.

FIG. 2 is a cutaway view of the Twisting Translational Displacement Pump Cartridge in the first machine state "Prime". It illustrates the position of the two moveable cores 5. The left moveable core 5 is tangent to the rearward edge of reservoir perpendicular passage 2, the moveable core 5 on the right side maintains a position tangent to the rearward edge of the prime or bulk feed perpendicular passage 3. This opens a path for fluid to flow between the two openings. If the pump reservoir is full of liquid the first machine state that must be performed is "Prime", fluid flows from the reservoir perpendicular passage 2 into the space between the two moveable cores 5 then out the prime or bulk feed perpendicular passage 3. When all air has been expelled from the fluid entering the space, the moveable core 5 on the right twists clockwise to the forward edge of the prime or bulk feed perpendicular passage 3 shutting off the perpendicular passage 3. The gear 9 enables rotation of the polymer shell 1 around the datum axis using bearing surfaces 11. A pressure sensor 10 is installed in the bulkhead of the polymer shell 1.

If the on board reservoir 25 is depleted of fluid, the moveable cores 5 in the pump return to the position illustrated in FIG. 2. In this situation, fluid can be pushed through the bulk feed perpendicular passage 3, through the path in the polymer shell 1, through the reservoir perpendicular passage 2 and into the empty reservoir chamber 25 connected to the reservoir perpendicular passage 2. Alternately, the same process could occur with the exception that fluid is pulled through by a source of vacuum connected to the reservoir chamber 25. In cases where air pressure or vacuum is not available, the moveable core 5 tangent to right side or rearward edge of the bulk feed perpendicular passage 3 would remain in the same position as in FIG. 2 but the moveable core 5 on the left would change position; the oblate ends of the moveable cores 5 touching, the left moveable core 5 twists backward in a counterclockwise direction creating the vacuum necessary to draw the fluid from a bulk supply into the expanding volume contained within the polymer shell 1. The left 5 stops tangent to the right side or forward edge of the reservoir passage 2; then both left and right moveable cores 5 twist, the right one clockwise moving forward shutting off the bulk feed perpendicular passage 3, the left one counterclockwise stopping at the opposite tangent edge or rearward edge of the reservoir perpendicular passage 2, exposing the perpendicular passage. The right moveable core 5 advances as it rotates clockwise toward the now stationary left moveable core 5, extruding the fluid contained between the two moveable cores 5 into the reservoir 25. Once fluid has been displaced into the reservoir 25, the two moveable cores 5 move to the bulk feed perpendicular passage 3, the right one retracts by rotating counterclockwise, the left one advances by rotating clockwise. The right moveable core 5 stops at a position tangent to the rearward edge of the bulk feed perpendicular passage 3, the left moveable core 5 continues to move forward by rotating clockwise until the oblate ends on each of the moveable cores 5 touch at the rearward edge of the bulk feed perpendicular passage 3. This sequence of movements occurs until the on board reservoir 25 is refilled.

Figure 3:
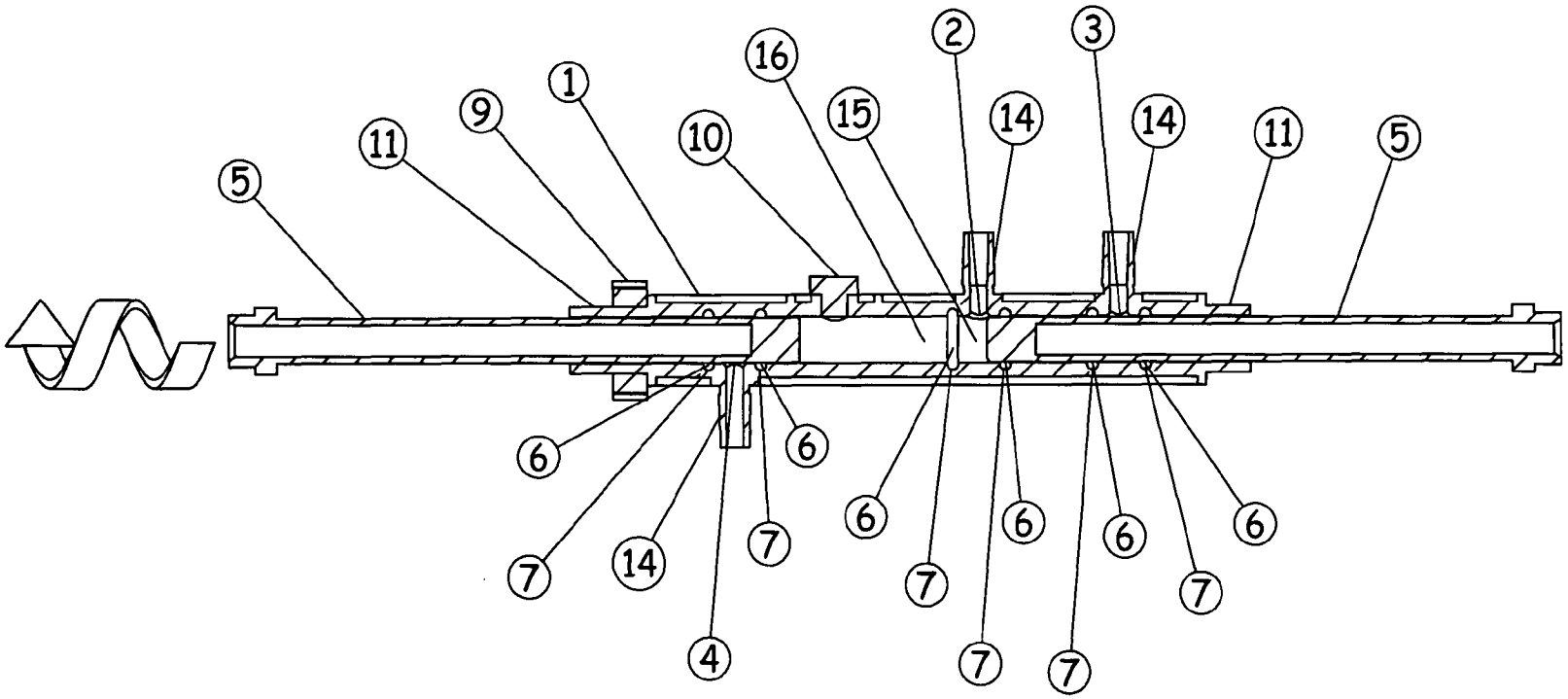
FIG. 3 is an illustrative view of the second machine state of operation, "Refill".

FIG. 3 is a cut away view of the Twisting Translational Displacement Pump Cartridge in the "Refill" state. It illustrates the position of the moveable cores 5 in the machine state of replenishing the large cavity 16 in the polymer shell 1 with liquid. The right moveable core 5 is stationary at a position tangent to the rearward edge of the reservoir perpendicular passage 2. In this position the right moveable core 5 shuts off the prime or bulk feed perpendicular passage 3. The left 5 retracts by rotating counterclockwise; the negative pressure produced pulls fluid through the reservoir perpendicular passage 2 and fills the space between the oblate ends of the moveable cores 5. The left moveable core 5 stops rotating counterclockwise before reaching the forward edge of exit perpendicular passage 4; the remaining distance must be equal to the diameter of reservoir perpendicular passage 2 to allow for shutoff of the perpendicular passage 2 in the next state.

Figure 4:
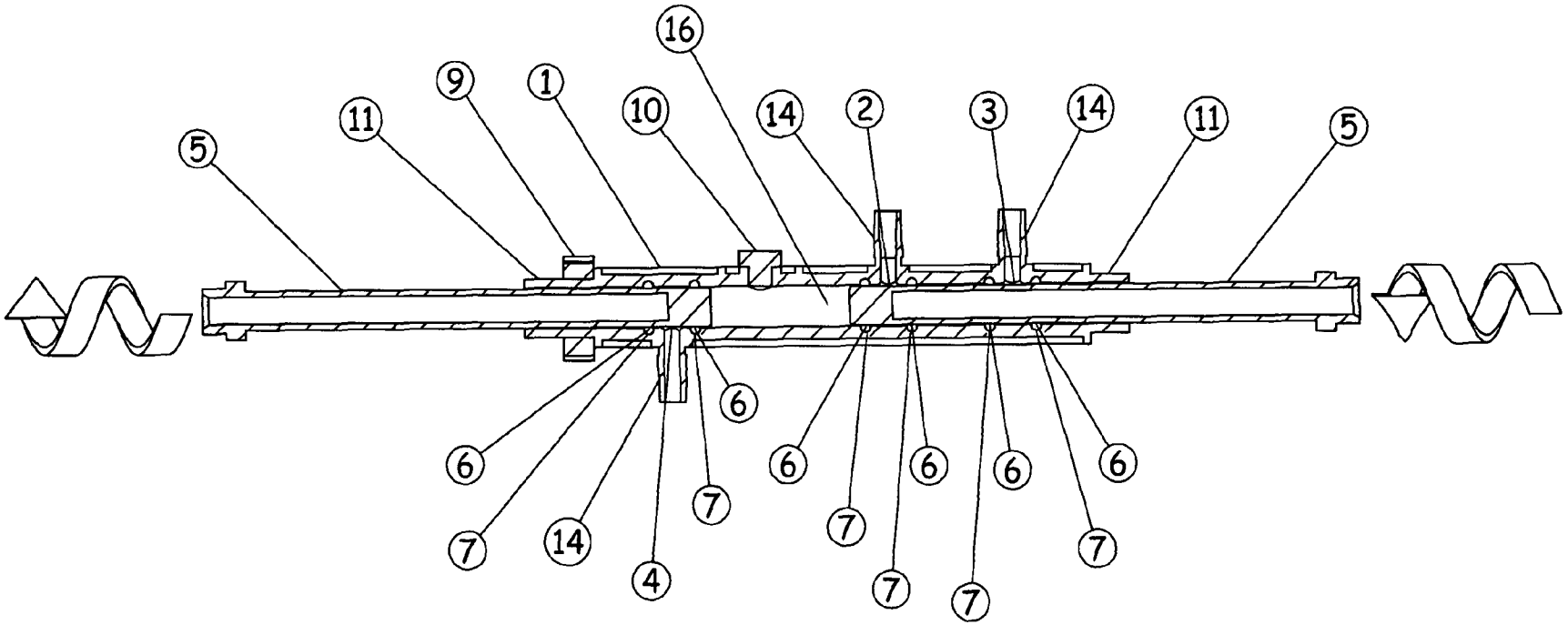
FIG. 4 is an illustrative view of the third machine state, "Translate".

FIG. 4 is a cut away view of the Twisting Translational Displacement Pump Cartridge in the "Translate" state. At the conclusion of the "Refill" state the right moveable core 5 rotates clockwise, the left moveable core 5 rotates counterclockwise; the right rotates forward as the left rotates backward closing the reservoir perpendicular passage 2. Since both moveable cores 5 rotate using the same pitch no force is exerted across the area of the fluid column; therefore, there is no increase in pressure, the volume of liquid is moved in a linear fashion along the bore of the large cavity 16 contained within the polymer shell 1. The machine state, "Translate", concludes when the volume of fluid is positioned over the exit perpendicular passage 4. This can occur two ways: The fluid volume between the oblate ends of the moveable cores 5 can be moved to a position that straddles the exit perpendicular passage 4, or the left moveable core 5 can park in a position tangent to the rearward edge of the exit perpendicular passage 4.

Some liquids like sealants and silicones exhibit a degree of compressibility. It is desirable when pumping fluids with these attributes to determine the compressibility offset. This is useful because pressure must be exerted on the fluid to compress it before it actually moves. In these instances the illustration in FIG. 4 can be used to demonstrate not only twisting translation but also pressure versus moveable core 5 positions to determine an offset by reversing the direction of twist and or pitch arrow of the left moveable core 5. To accomplish this task, instead of translating the liquid column, the moveable cores 5 would move toward each other, the right side moveable core 5 rotating or twisting clockwise while the left side moveable core 5 is also twisting or rotating clockwise against the fluid column at a point in the large cavity 16 of the polymer shell 1 that has no access to any of the perpendicular passages 2, 3, 4, but a pressure sensor 10 would need to be installed at the location. The offset would be a function of displacement and pressure and would also be useful to compensate for compliance in statically mounted elastomers 6 utilized in interior sulcusci 7 for incompressible fluids.

Figure 5:
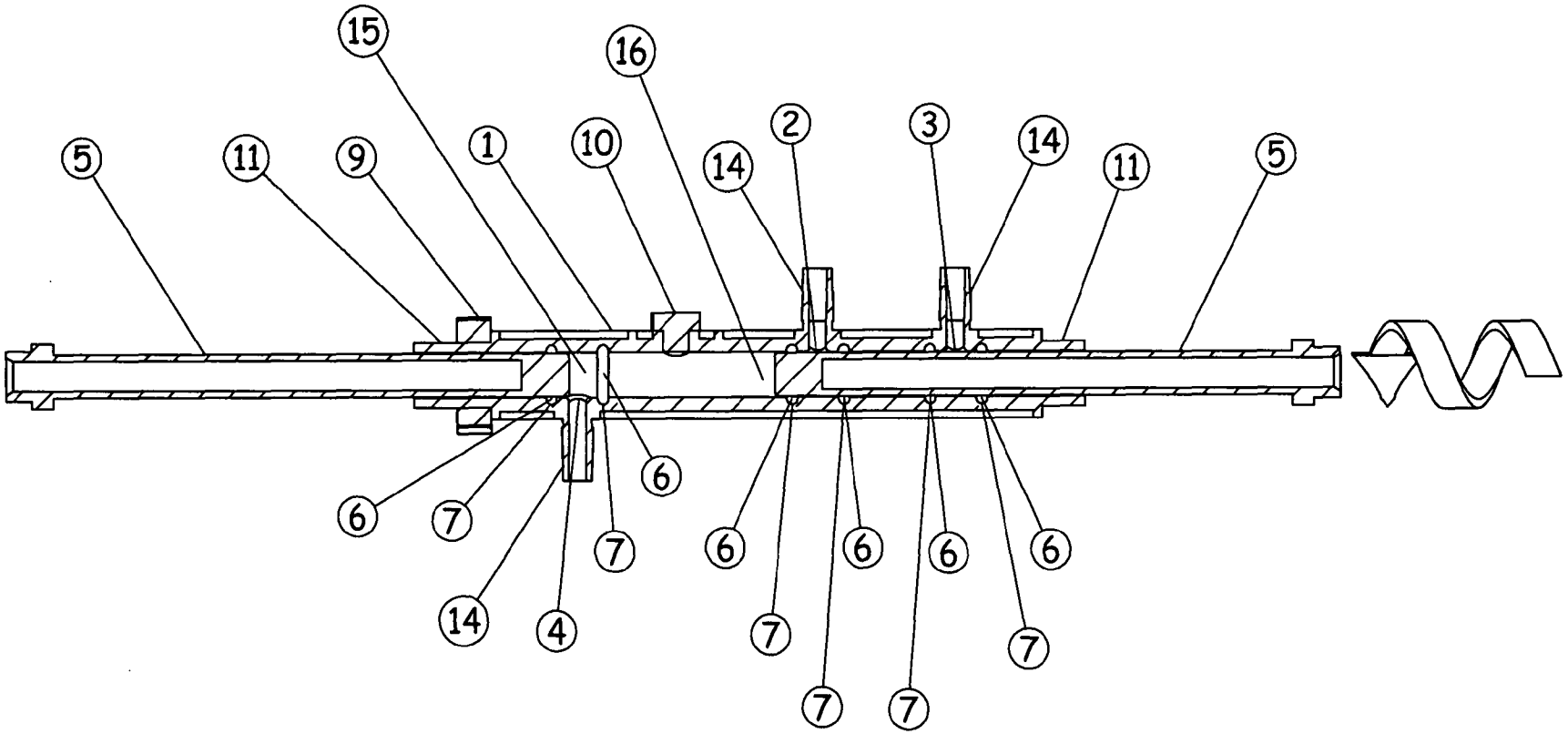
FIG. 5 is an illustrative view of the fourth machine state, "Dispense".

FIG. 5 is a cut away view of the Twisting Translational Displacement Pump Cartridge in the "Dispense" state. End of the "Translate" state readies the pump for extrusion of fluid contained between the oblate ends of the moveable cores 5. The fluid column can be positioned as illustrated in FIG. 5 with the left moveable core 5 stationary or stopped at a position with the oblate end of the moveable core 5 tangent to the rearward edge of the exit perpendicular passage 4 or the fluid column can straddle the exit perpendicular passage 4. In the first scenario, the right moveable core 5 moves toward the stationary moveable core 5 on the left by twisting clockwise, the force exerted on the area of the cross section of the fluid column creating the pressure required to move the fluid out the exit perpendicular passage 4 through a nozzle 13 and onto the work plane. The second scenario places the column of fluid in a position so the center of the column is in line with the exit perpendicular passage 4; each moveable core 5 advances toward each other by twisting clockwise, pushing against the fluid column from both ends. This aspect of the invention is useful to enable the pump to achieve high rates of flow from high viscosity fluids; pressure requirements increase in this situation, demanding more force exerted across the area of the fluid column. To produce the force, more torque is necessary. A low gear ratio is desirable; however, as torque is increased the velocity of advancement influenced by the pitch of the twist of the moveable cores 5 is decreased. Since both moveable cores 5 can move toward each other the relative velocity of extrusion with respect to the fluid expelled out the exit perpendicular passage 4 is doubled.

FIG. 6 is an exploded view illustration of the basic components in the novel Twisting Translational Displacement Pump Cartridge. The illustration shows the basic components required to construct the pump. The polymer shell 1 provides the structure for the moveable cores 5 to move within by twisting. Moveable cores 5 are hollow internally to provide space for retraction of the helical shaft 24 necessary to enable twisting of the moveable cores 5 to lower torque requirements when the moveable cores 5 intermittently contact and compress statically mounted elastomers 6 in interior sulcusci 7. Interior sulcusci 7 are adjacent and within close proximity to the bulk feed or prime perpendicular passage 3, reservoir perpendicular passage 2 and exit perpendicular passage 4. Perpendicular passages are attached to standard tapers 14 for connection to a nozzle 13, fluid source 25, and prime chamber. The polymer shell 1 is separated into two halves to facilitate molding interior sulcusci 7 for containment of statically mounted elastomer material 6 at the required discrete locations in the smaller cavities 15. Connection of each half of the polymer shell 1 can be accomplished by using adhesives or ultrasonic welding. Standard tapers 14 are installed into perpendicular passages 2, 3, 4 by mechanical fastening methods or ultrasonic welding. A pressure sensor 10 mounts on the topside of the polymer shell 1 to determine pressure in the large cavity 16. Two bearing surfaces 11 are provided to form a datum axis for rotation by the gear 9. The Twisting Translational Displacement Pump Cartridge can be discarded to reduce operator contact with cleaning solvents and pump fluids while retaining the higher cost gear 9 and pressure sensor 10 for reuse in the next cartridge.

FIG. 7 is an end view of the novel Twisting Translational Displacement Pump Cartridge looking from the left side. The illustration shows an additional inventive aspect of the device; the ability to add an additional degree of freedom of motion on the cartridge that does not have any influence on fluid movement in the wetted path as it rotates. An arrow in the shape of a semicircle indicates the angular rotation possible with respect to the work plane. Rotation around the bearing surface 11 occurs through application of torque through gear 9. This results in a change in angular position with respect to the surface of the work plane of the polymer shell 1 and perpendicular passages 2, 4 and 3 although perpendicular passage 2 connected to standard taper 14 are the only ones visible in this view, which moves the nozzle 13 to a position other than perpendicular to the surface of the work plane. The rotation adds an additional twisting motion to the helical motion of the moveable cores 5 further reducing stick slip and torque requirements as the moveable cores 5 expand and contract the statically mounted elastomers 6 utilized in the interior sulcusci 7 visible in FIG. 6. Barely visible above the gear 9 is the pressure sensor 10.

While the invention has been described with reference to a particular embodiment thereof, those skilled in the art will be able to make various modifications to the described embodiment of the invention without departing from the true spirit and scope thereof. It is intended that all combinations of elements and steps, which perform substantially the same function in substantially the same way to achieve substantially the same result, be within the scope of this invention.

What is claimed is:

1. A twisting translational displacement pump cartridge comprising:

a) a polymer shell containing a large cavity located between two smaller cavities along a longitudinal axis of said polymer shell, and wherein perpendicular passages intersect said smaller cavities along said longitudinal axis;

b) moveable cores closely fit inside said polymer shell;

c) interior sulci in said polymer shell located within close proximity and adjacent to each side of said perpendicular passages along said longitudinal axis;

d) a standard taper surrounding an outer perimeter of said perpendicular passages to connect nozzles suitably designed to mate with said standard taper;

e) a gear or pulley at least partially surrounding said polymer shell concentric to the longitudinal axis; and f) a bearing surface surrounding an outer perimeter of said polymer shell to support rotation of said polymer shell wherein said moveable cores rotate clockwise or counterclockwise while translating along the longitudinal axis to increase or reduce a volume of the large cavity, thereby reducing the propensity for stick slippage or sticking of said movable cores against interior surfaces of the polymer shell used for sealing against the cores.

2. The twisting translational displacement pump cartridge of claim 1, wherein said cores occlude said perpendicular passages which operate as input and output passages, a core position is measured and recorded as said cores advance to reduce the volume of said large cavity, a means of determining pressure is provided in said polymer shell containing said large cavity and liquid pressure is measured and recorded whereby calculation of an offset in displacement to achieve a given pressure for compressible fluids is made and used for control correction.

3. The twisting translational displacement pump cartridge of claim 1, wherein a blind hole down a center of said moveable cores provides clearance for advance or retreat of a smooth or helical shaft.

4. The twisting translational displacement pump cartridge of claim 1, wherein an angular position of said polymer shell standard taper is changed by controlled rotation of said gear or pulley thereby enabling accurate angular placement of said nozzles to deposit fluid at a plurality of different angles.

5. The twisting translational displacement pump cartridge of claim 1, wherein said cores rotate counterclockwise or clockwise while translating, varying a rotation angle and translation position thereby manipulating a relative distance between said cores in said polymer shell.

6. The twisting translational displacement pump cartridge of claim 1, wherein no contact with the bulkhead of said large cavity by said moveable cores occurs thereby eliminating abrasive wear, higher friction and tight internal bore tolerance over greater distance.

7. The twisting translational displacement pump cartridge of claim 1, wherein said moveable cores articulate by manipulating said rotation angle and a translation position cannot reduce a volume in said large cavity contained within said polymer shell to substantially zero.

8. The twisting translational displacement pump cartridge of claim 1, wherein statically mounted elastomers are utilized in said interior sulcusci surrounding an inner perimeter of said smaller cavities adjacent to said perpendicular passages.

9. The twisting translational displacement pump cartridge of claim 1, wherein a plurality of said perpendicular passages connect to said nozzles using said standard taper or other means of connection thereby enabling output of fluid from multiple locations.

10. The twisting translational displacement pump cartridge of claim 1, wherein there are multiple said perpendicular passages, each of said perpendicular passage connects a reservoir through said standard taper or other means of connection to function as an input for fluid into said polymer shell thereby enabling input from more than a single fluid source.

* * * * *